United States Patent [19]

Kawano

[11] Patent Number: 4,675,632

[45] Date of Patent: Jun. 23, 1987

[54] COAXIAL LINE SHAPE RESONATOR WITH HIGH DIELECTRIC CONSTANT

[75] Inventor: Minori Kawano, Amagasaki, Japan

[73] Assignee: Mitsubishi Denki Kabushiki Kaisha, Tokyo, Japan

[21] Appl. No.: 703,723

[22] Filed: Feb. 21, 1985

[30] Foreign Application Priority Data

Feb. 23, 1984 [JP] Japan ..... 59-34543
Feb. 28, 1984 [JP] Japan ..... 59-38309

[51] Int. Cl.[4] ..... H01P 7/04
[52] U.S. Cl. ..... 333/222; 333/206
[58] Field of Search ..... 333/222, 223, 219, 220, 333/202, 206, 207, 185; 361/302, 313

[56] References Cited

U.S. PATENT DOCUMENTS 2,779,925 1/1957 Black ..... 333/222
3,137,808 6/1964 Coda et al. ..... 361/302
3,177,415 4/1965 Kater ..... 3612/302 X
4,079,343 3/1978 Nijman ..... 333/185 X
4,223,287 9/1980 Nishikawa et al. ..... 333/223
4,424,551 1/1984 Stevenson et al. ..... 361/302

*Primary Examiner*—Eugene R. LaRoche
*Assistant Examiner*—Benny Lee
*Attorney, Agent, or Firm*—Lowe Price LeBlanc Becker & Shur

[57] ABSTRACT

A high dielectric constant element suitable for making a coaxial line shape resonator comprises a number of sheets, for instance, of mica or plastic, each having plural pieces of conductive film or electrodes provided on one face with appropriate small gaps inbetween, the sheets being assembled in a pile to form a high dielectric constant element body that has high equivalent $\epsilon$ value without using a conventional high dielectric constant ceramic body. Fine adjustment of the resonance frequency of the coaxial line shape resonator is easily made by adjusting number of sheets per length.

5 Claims, 8 Drawing Figures

COAXIAL LINE SHAPE RESONATOR WITH HIGH DIELECTRIC CONSTANT

BACKGROUND OF THE INVENTION

1. Field of the Invention

The present invention generally relates to a coaxial line shape resonator with a high dielectric constant element, and particularly to minimization of the resonator size by using a high dielectric constant element therein.

2. DESCRIPTION OF THE PRIOR ART

Hitherto, high dielectric constant elements suitable for use in resonance elements or high frequency filters have been made of high dielectric constant ceramic. FIG. 1 shows a prior coaxial line shape resonator, which comprises an inner conductor 1 of a tubular shape disposed in a central hole or aperture 5, a high dielectric constant ceramic body 3 formed around the inner conductor, and an outer conductor 2 formed on the outside faces of the high dielectric constant ceramic body 3 except for its top surface. The lower end of the inner conductor 1 is electrically connected to the bottom part of the outer conductor 2. The above-mentioned construction is contained in a metal case 4. In such a coaxial line shape resonator, the wavelength $\lambda_g$ of the electromagnetic wave in the resonator is given by the following equation:

$$\lambda_g = \frac{1}{f\sqrt{LC}} = \frac{1}{\sqrt{\epsilon}} \cdot \frac{1}{f\sqrt{LC_0}}, \quad (1)$$

wherein f is the frequency of the electromagnetic wave, L is the inductance per unit length of the coaxial line, C is the capacitance per unit length of the coaxial line, $\epsilon$ is the specific dielectric constant of the high dielectric constant ceramic body 2 and $C_0$ is the capacitance per unit length of the coaxial line when there is no high dielectric constant body 2.

As shown by the above-mentioned equation, by inserting the high dielectric constant body 2 in the coaxial line shape resonator, the wavelength $\lambda_g$ in the coaxial line shape resonator can be shortened to $1/\sqrt{\epsilon}$ times that for the coaxial line shape resonator without the high dielectric constant body 2. Therefore, the insertion of the high dielectric constant ceramic body in the cavity part of the resonator can effectively shorten its length. However, the high dielectric constant ceramic which is made by firing the raw ceramic material has great difficulty in working after the firing, and accordingly, adjustment of the resonance frequency by adjusting the size of the high dielectric constant ceramic body is very difficult. Also, the high dielectric constant ceramic body is expensive. Furthermore, the conventional high dielectric constant ceramic known in the prior art has a considerable temperature dependency in its $\epsilon$ value, therefore, the $\epsilon$ in reality is limited to a low value of about 40.

SUMMARY OF THE INVENTION

Accordingly, the purpose of the present invention is to provide a resonator which has a high dielectric constant element. The present invention also resolves the problems that are encountered in the high dielectric constant element mentioned above.

Thus, the purpose of the present invention is to provide a high dielectric constant element having higher $\epsilon$ value, which can be, easily adjusted for the size (length along the inner conductor of the coaxial line shape resonator when applied thereto) and which is inexpensive to manufacture.

The high dielectric constant element in accordance with one embodiment of the present invention comprises:

plural sheets of dielectric substance piled one on another vertically, along with the inner and outer conductors of a coaxial line shape resonator, thus forming a piled body, and plural pieces of conductive film provided on at least one face of each of the sheets of dielectric substance, the plural pieces of conductive film being disposed in a manner to have gaps between each other.

The high dielectric constant element in accordance with the present invention in another embodiment further comprises:

an inner conductor which is disposed across the top face to the bottom face of the piled body in a through-hole formed so as to penetrate the interfaces between the plural sheets of dielectric substance, and an outer conductor which is disposed to surround the piled body extending from a peripheral part of the top face to the bottom face.

The resonance device in accordance with the present invention comprises such a high dielectric constant element in which the plural pieces of conductive film are formed along coaxial positions on each of the sheets of dielectric substance, most inner pieces thereof being connected to the inner conductor and most outer pieces thereof being connected to the outer conductor.

DESCRIPTION OF THE PREFERRED EMBODIMENT

Figure 1:
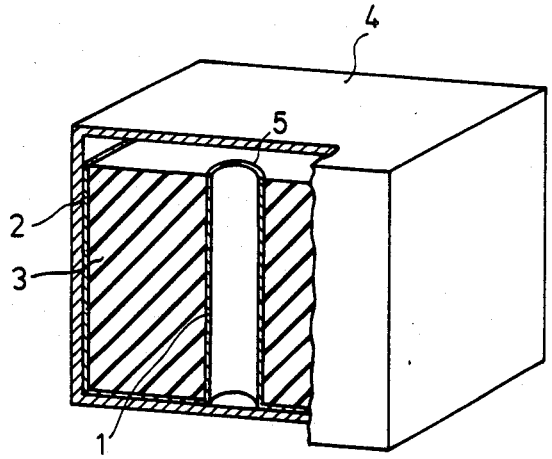
FIG. 1 (PRIOR ART)
FIG. 1 is a partly broken perspective view of a conventional coaxial line shape resonator of the prior art using a high dielectric constant material.
Figure 2:
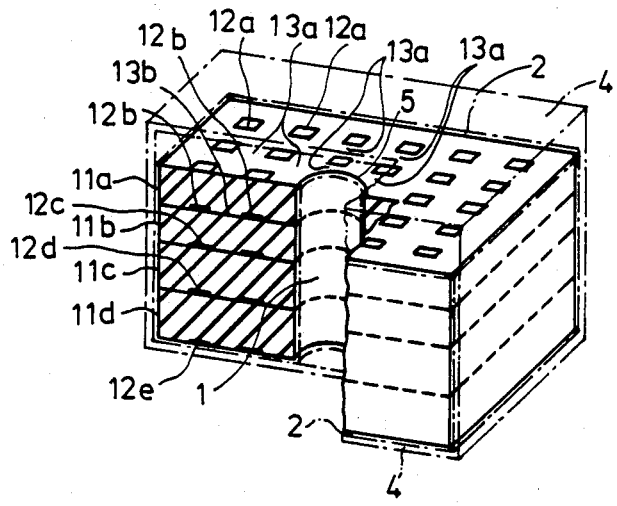
FIG. 2 is a partly broken perspective view showing a first embodiment of the invention.

FIG. 2 shows a first embodiment. As shown in FIG. 2, the high dielectric constant element consists of plural sheets 11*a*, 11*b*, 11*c*, 11*d*, . . . of a high dielectric constant material such as mica sheet, or thin ceramic sheet each having a number of small pieces of electrodes 12*a*, 12*b*, . . . formed in a predetermined distribution on a surface thereof with insulation gaps 13*a*, 13*b*, . . . therebetween, by known method of printing with conductive paint, vacuum deposition of Au, Al or Cu combined with etching, or the like. Then a number of such dielectric sheets are assembled in a pile. In a center hole or aperture 5 through each of the piled sheets an inner conductor 1 is disposed, and on the outside surfaces of the piled body an outer conductor 2 is provided, and the bottom part of the outer conductor 2 and the center conductor 1 are each other electrically connected. That is, a pile of dielectric material sheets with scattered small electrodes on each sheet used in place of the conventional high dielectric constant ceramic body in a coaxial line shape resonator in this embodiment. The assembled coaxial line shape resonator is encapsulated in a container 4.

Figure 3:
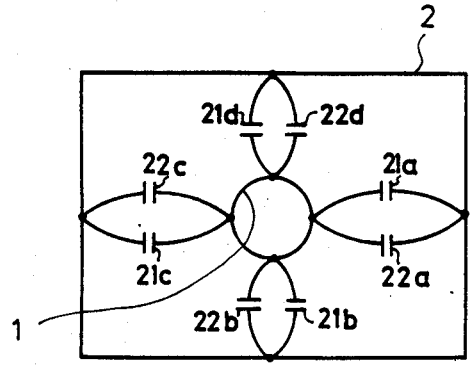
FIG. 3 is an equivalent circuit diagram schematically illustrating the principle of the embodiment of FIG. 2.

FIG. 3 is an equivalent circuit diagram of a dielectric sheet with electrodes disposed thereon. As shown schematically in FIG. 3, the scattered electrodes with small gaps therebetween on the dielectric sheet form the equivalent of a circuit comprising many capacitances 21*a*, 21*b*, 21*c*, 21*d*, . . . and other capacitances 22*a*, 22*b*, 22*c*, 22*d*, . . . . The former capacitances 21*a*, 21*b*, 21*c*, 21*d*, . . . are stray capacitances originally existing between the inner conductor 1 and the outer conductor 2 when the electrodes 12*a*, 12*b*, . . . are not provided. The other capacitances 22*a*, 22*b*, 22*c*, 22*d*, . . . represent stray capacitances that are the result of providing the scattered electrodes on the dielectric sheet. Now, provided that the total of the former capacitances is $C_1$ and the total of the latter capacitances is $C_2$, then, an equivalent dielectric constant of this sheet becomes $$\epsilon = \frac{C_1 + C_2}{C_1} = 1 + \frac{C_2}{C_1}. \quad (2)$$

Since $C_2/C_1$ is sufficiently larger than 1 when the in between gaps 13*a*, 13*b*, . . . are small, the above-mentioned equation (2) can be rewritten as follows:

$$\epsilon \approx C_2/C_1 \quad (3).$$

That is, by providing the small electrodes scattered with small gaps in between on the dielectric sheets uniformly between the inner conductor 1 and the outer conductor, an arbitrary value of the equivalent specific dielectric constant $\epsilon$ is obtainable, as shown by the equation (3). Experiments show that the smaller the size of the scattered electrodes, 12*a*, the smaller a high frequency loss becomes. Some of these scattered electrodes 12*a* will be located closer to the aperture, i.e., be at "inner" locations, while others will be closer to the outer edges of the dielectric sheets, i.e., be at "outer" locations.

Since the high dielectric constant element of this embodiment consists of a piled body, the equivalent dielectric constant can be further adjusted by adjusting the number of the sheets of the configuration shown in FIG. 2, for instance, by mixing a plain spacer sheet consisting of a very thin film of mica or ceramic between adjacent sheets in the pile of sheets. Thus, very fine adjustment of the equivalent $\epsilon$ value, and hence very fine adjustment of the resonance frequency of a coaxial line shape resonator comprising the embodiment element is easily achievable at a low expense.

As a modified embodiment, the electrodes may be formed on both faces of the dielectric sheet. In case the electrodes on both faces are disposed in partly superposing relations, the above-mentioned capacitance $C_2$ can be made very large, and hence a large value of the equivalent dielectric constant $\epsilon$ is obtainable.

Figure 4:
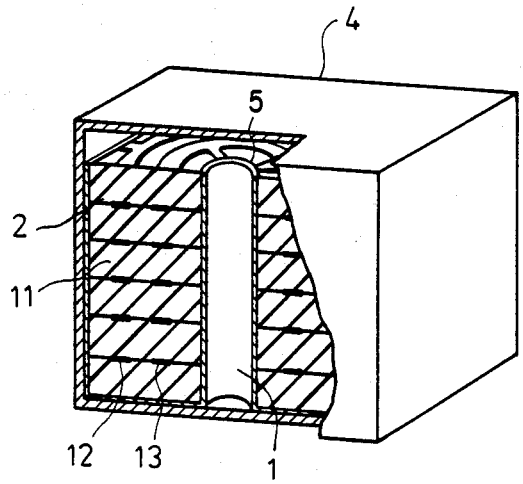
FIG. 4 is a partly broken perspective view of a second embodiment of the present invention.
Figure 5:
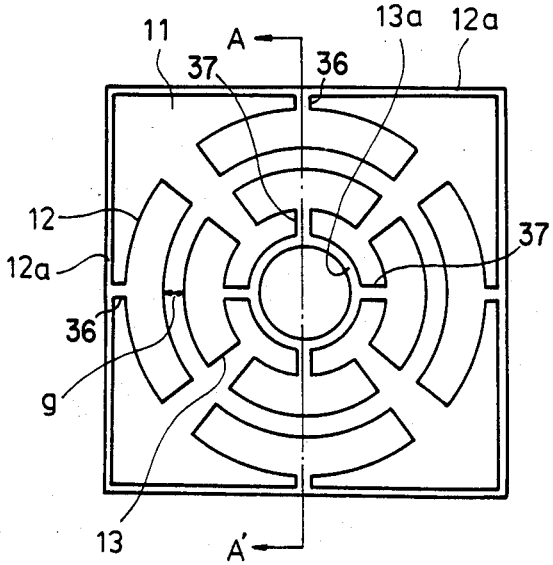
FIG. 5 is a plan view showing one sheet of the high dielectric constant element of the embodiment of FIG. 4.
Figure 6:
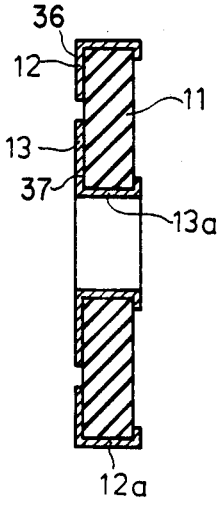
FIG. 6 is a sectional view at AA' section of FIG. 5.

FIGS. 4 to 7 show another embodiment, whereof FIG. 4 is a broken perspective view. In this embodiment, a high dielectric constant element comprises a number of piled sheets each comprising plural pieces of conductive film as electrodes provided on one face of the sheet. The electrodes 12 and 13 are formed by known methods of printing with conductive paint, vacuum deposition of Au, Al or Cu combined with etching, or the like, along coaxial positions around a center hole in each sheet. The electrodes are formed with small gaps g in between as shown in the plan view of FIG. 5. Furthermore, the outer electrodes 12 are connected by short extensions 36 to a peripheral bent part 12*a* and the inner electrodes 13 are connected by short extensions 37 to bent central part 13*a*, as shown in the cross-sectional view of FIG. 6. Then a number of sheets with the coaxially formed electrodes are piled to form the high dielectric constant element. When the pile is assembled into a coaxial line shape resonator, as shown in FIG. 4, an inner conductor 1 which is inserted in the through-hole of the piled dielectric constant element is connected to the inner electrodes 13 by the bent part 13*a*. An outer conductor 2 formed around the piled high dielectric constant element is also connected to each of the outer electrodes 12 by the bent parts 12*a*. The assembled coaxial line shape resonator is encapsulated in a metal case 4.

Figure 7:
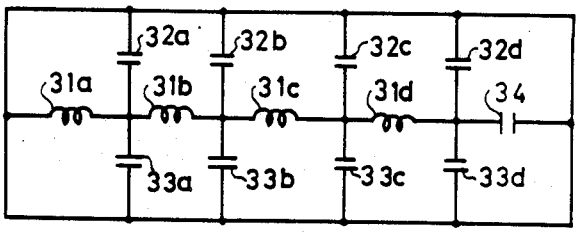
FIG. 7 is an equivalent circuit diagram of the embodiment of FIG. 4.

An equivalent circuit of the resonator can be drawn as shown in FIG. 7. In the equivalent circuit of FIG. 7, 31*a*, 31*b*, 31*c*, 31*d*, . . . designate distributed inductances, 32*a*, 32*b*, 32*c*, 32*d*, . . . and 33*a*, 33*b*, 33*c*, 33*d*, . . . designate distributed capacitances, and 34 designates a resonance capacitance, and the above-mentioned elements as a whole constitute the coaxial line shape resonator. When, for example, thin mica sheets are used as the dielectric sheet 11, a great number of the dielectric sheets can be piled in a short axial length, since the thin mica sheet is only several tens of microns thick.

Now it is provided that in a coaxial line shape resonator, in which the capacitance per length is $C_0+C_1$, wherein $C_0$ is capacitance per length when the specific dielectric constant of the sheet is 1 and $C_1$ is the incremental part of the capacitance per length corresponding to any difference in the actual dielectric constant of the dielectric sheet 11, and the inductance per length is L, then the wavelength $\lambda'_g$ of an electromagnetic wave in the resonator element is given as follows:

$$\lambda'_g = \frac{1}{f} \frac{1}{\sqrt{L(C_0 + C_1)}}. \quad (4)$$

Then by defining $$C_1 = nC_0 \quad (5),$$

the above-mentioned wavelength $\lambda'_g$ can be represented as follows.

$$\lambda'_g = \frac{1}{\sqrt{n+1}} \cdot \frac{1}{f\sqrt{LC_0}}. \quad (6)$$

This equation (6) shows that length of the coaxial line shape resonator can be shortened to $$\frac{1}{\sqrt{n+1}}.$$

That is, the axial length of the resonator can be shortened significantly in comparison with the conventional high dielectric constant element.

As compared with the conventional high dielectric constant element where the axial length shortening factor is determined by the dielectric constant of the material, the axial length of the resonator of this embodiment is determined by stray capacitance between the inner electrode 13 and the outer electrode 12 formed on each dielectric sheet. Therefore, the axial length of the resonator according to this invention can be effectively shortened even when dielectric sheets of small dielectric constant are used.

Furthermore, since a large number of the dielectric sheets having the electrodes formed thereon are assembled in a piled state, fine adjustment of the resonance frequency of the resonator can be made by adjustment in the number of sheets per unit of resonator axial length. Furthermore, when mica or appropriate plastic film is used as the dielectric sheet, the temperature dependency of the dielectric constant can be made very small, and therefore the temperature dependency of the resonance frequency can be minimized, and the manufacturing cost is not expensive.

Figure 8:
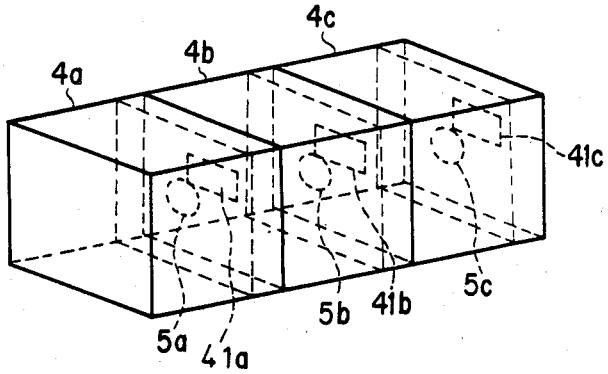
FIG. 8 is a perspective view of a band-pass filter made by combining resonators of the present invention.

FIG. 8 shows another embodiment wherein several coaxial line shape resonators 4*a*–4*c* are connected in parallel series by their coupling apertures 41*a*–41*c*, and 5*a*–5*c* are the cylindrical apertures to adjust the resonance frequencies of the coaxial line shape resonators in this embodiment. Then by appropriately selecting resonance frequencies thereof in different ones of the resonators, a desired band-pass characteristic is produced for them when connected together.

What is claimed is:

1. A coaxial line shape resonator device, comprising:

a plurality of similarly shaped sheets made of a dielectric material, each provided with an aperture therethrough, said plurality of sheets assembled to form a neat pile with said apertures of said sheets being aligned so as to provide a cylindrical pile aperture through said assembled pile;

a cylindrical inner conductor located within said cylindrical pile aperture;

an outer conductor located outside said cylindrical pile aperture; and a plurality of pieces of electrically conductive film disposed in a predetermined pattern about said apertures on at least one side of each of said sheets, said pieces of conductive film being separated from each other so as to have gaps between said pieces, with at least one piece of said conductive film so disposed as to have no direct physical contact with any conductive film that is located on the opposite side of that sheet upon which said pieces of conductive film are disposed, said pattern being selected such that most but not all inner located pieces of conductive film adjacent said pile cylindrical aperture are in direct contact with said cylindrical inner conductor and most but not all outer located pieces of conductive film located away from said pile cylindrical aperture are in direct contact with said outer conductor.

2. A coaxial line shape resonator device according to claim 1, wherein:

said dielectric material comprises a high dielectric constant ceramic.

3. A coaxial line shape resonator device according to claim 1, wherein:

said dielectric material comprises mica.

4. A coaxial line shape resonator device according to claim 1, wherein:

said pieces of conductive film in contact with said inner and outer conductors are conductively bonded to said inner and outer conductors, respectively, to form the assembled pile.

5. A coaxial line shape resonator device according to claim 4, further comprising:

a sealable metal container means for containing and sealing said assembly, with contacts to said inner and outer conductors provided, said container being formed with a cylindrical aperture communicating with said cylindrical pile aperture in said assembly.

* * * * *